United States Patent [19]

Garner

[11] 4,224,090

[45] Sep. 23, 1980

[54] POWDER FILLING OF ELECTRIC CABLES, WITH CABLE VIBRATING MEANS

[75] Inventor: John N. Garner, Pointe Claire, Canada

[73] Assignee: Northern Telecom Limited, Montreal, Canada

[21] Appl. No.: 52,233

[22] Filed: Jun. 26, 1979

[51] Int. Cl.[2] ..... H01B 13/16

[52] U.S. Cl. ..... 156/48; 118/634; 118/DIG. 5; 427/117; 427/118; 427/120; 427/185

[58] Field of Search ..... 156/48; 118/DIG. 5, 118/634; 427/117, 118, 120, 185

[56] References Cited

U.S. PATENT DOCUMENTS

| | | | |
|---|---|---|---|
| 3,889,455 | 6/1975 | Portinari | 156/48 |
| 4,084,019 | 4/1978 | Christ | 118/DIG. 5 |
| 4,100,002 | 7/1978 | Woytink | 156/48 |
| 4,122,212 | 10/1978 | Walling | 427/185 |

OTHER PUBLICATIONS

"Fluidized Bed Coating", J. Gaynor, Chemical Engineering Progress, vol. 56, No. 7, pp. 75–78, 1960.

"Fluidized Bed Method of Coating", L. Stott, Organic Finishing, Jun. 1956, pp. 16–17.

*Primary Examiner*—Marion McCamish

*Attorney, Agent, or Firm*—Sidney T. Jelly

[57] ABSTRACT

Powder filling of a cable, or cable unit, is improved by passing the cable, or unit through a fluidized bed of powder, and vibrating or shaking the cable, or unit in a direction substantially normal to the direction of movement of the cable, or unit, through the bed.

21 Claims, 9 Drawing Figures

POWDER FILLING OF ELECTRIC CABLES, WITH CABLE VIBRATING MEANS

This invention relates to the powder filling of electric cables, for example cables for telecommunications and is particularly concerned with the filling of cables with units of the cable in a substantially closed condition.

Conventionally, the voids between conductors of a cable, particularly a telecommunications cable, are filled with a material, for example grease. Use of grease is inconvenient, both in manufacture and in use. Particularly when the conductors of a cable have to be joined the grease creates problems in obtaining clean joints. It is also messy and unpleasant.

It has been proposed to fill the voids alternatively with a powder, and in one method the individual conductors are passed in spaced apart relationship through a first position where the conductors are oiled and then through a powder applicator. The conductors are then closed down into units of a cable, or a cable if the cable is of small size. The filling can sometimes be variable and the use of oil may still create problems at joining and also problems in obtaining continuous running of the filling apparatus as a build-up of oil and powder can jam dies in the bed.

In application Ser. No. 921,252 filed July 3, 1978, now abandoned, in the name of the present assignee there is described the filling of cables, or cable units, composed of a number of conductors, or pairs of conductors, in which the cables or units are filled in the substantially closed condition. Surprisingly it has been found that very effective filling can be obtained when the cable, or cable unit, is passed through a fluidized bed in the closed condition. The powder flows into the interstices between conductors and gives good filling characteristics.

The present invention provides for an improvement in the characteristics of the filled cable. The cable, or cable unit, is passed over a member which vibrates or shakes the cable while it is passing through the fluidized bed. It is believed that the vibration or shaking of the cable assists in maintaining the fluidity of the powder and thus provides an even higher uniformity of fill and improves the electrical characteristics of the cable.

Thus, in its broadest aspect, the present invention provides for vibrating or shaking, or otherwise agitating the cable or cable unit, as it passes through the fluidized bed of powder.

The invention will be readily understood by the following description of various embodiments by way of example, in conjunction with the accompanying drawings, in which:

FIG. 1 is a diagrammatic cross-section through one form of apparatus, in a direction normal to the path of the cable through the apparatus, a side view being seen in FIG. 5. The forms of apparatus illustrated in FIGS. 2, 3 and 4 vary only in the particular arrangement for vibrating or shaking the cable and similar reference numerals are used, where applicable.

Figure 1:
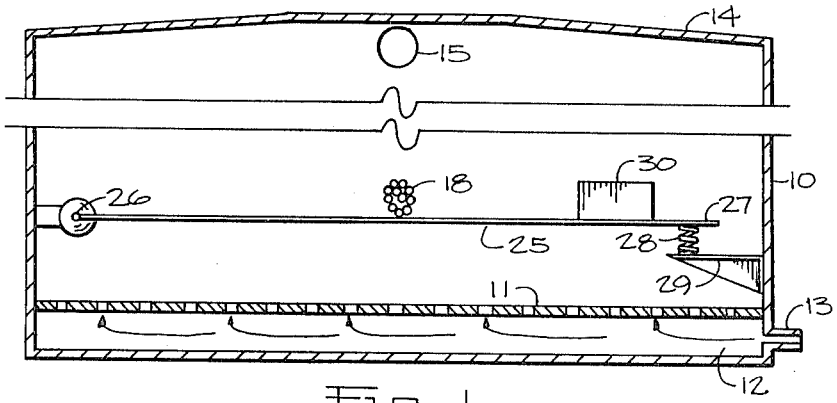
FIGS. 1 to 4 are diagrammatic vertical cross-sections of four alternative arrangements for vibrating or shaking a cable.
Figures 5, 6:
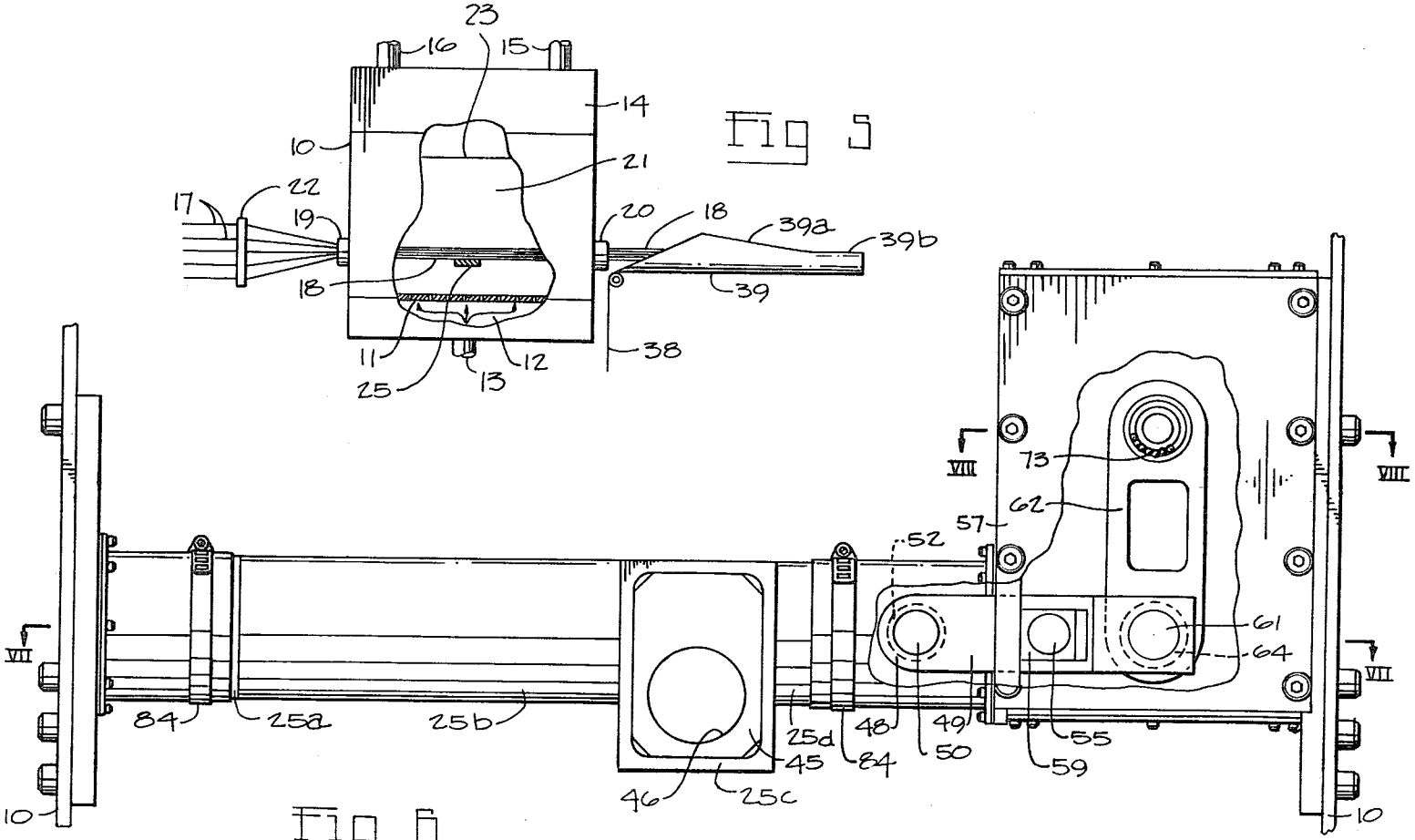
FIG. 5 is a diagrammatic side view of one form of the apparatus as in FIGS. 1 to 4.
FIG. 6 is a side view of a vibrating arrangement, as in FIG. 2, illustrated in more detail.

As illustrated in FIG. 1, and FIG. 5, a fluidized bed comprises a housing 10 having a porous plate 11 extending across the housing near the bottom, to define an air chamber 12, to which air is supplied via an inlet 13. A cover 14 fits on the housing and has an exhaust outlet 15 for removal of dust and an inlet 16 for the supply of powder. As illustrated in FIG. 5, the conductors 17 of a cable, or cable unit 18 enter the housing 10 via an inlet die 19 and exit via an exit die 20. In the housing or fluidized bed the cable, or cable unit, is in a substantially closed condition, that is the conductors 17 are closed down substantially into their final arrangement. With air admitted through inlet 13 and passing through the porous plate 11, the powder is fluidized, as indicated at 21 in FIG. 5, and the cable or cable unit passes through the fluidized powder, that is, below the top surface 23 of the fluidized powder bed. The powder enters the cable and passes between the conductors to fill the interstices. This is generally as described in the above mentioned application Ser. No. 921,252 A forming member 22 can be provided before the inlet die 19.

As illustrated in FIG. 1, the cable 18 passes over a bar 25 which is caused to move so as to vibrate the cable 18. In the particular example the bar 25 is pivotally mounted at one end at 26 and at the other end 27 as resiliently supported, as by a spring 28 on a bracket or other rigid support member 29. A vibrator 30 is mounted close to the end 27 of the bar 25. Vibrator 30 can be an electrical, mechanical, or pneumatic vibrator and applies a vertical vibratory movement to the bar 25. The action of the bar is to vibrate the cable 18 and it is believed that this vibratory or shaking movement assists in maintaining the fluidized condition of the powder as it enters the cable between the conductors. The vibratory movement of the cable is not such as will open the conductors to any extent, the cable remaining in a substantially closed condition.

Figure 2:
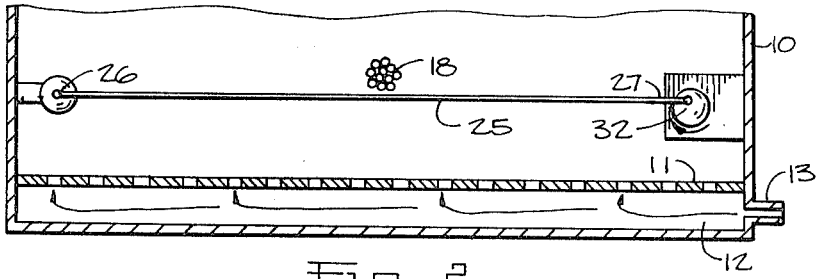

FIG. 2 illustrates an alternative arrangement in which the bar 25 is moved at its end 27 by a rotary eccentric device 32. The end of the bar can have a slot which engages over a pin eccentricity mounted on a rotating member for example, the axis of rotation normal to the longitudinal axis of the bar. Various other ways of attaching the end 27 of the bar to an eccentric can be appreciated.

Figure 3:
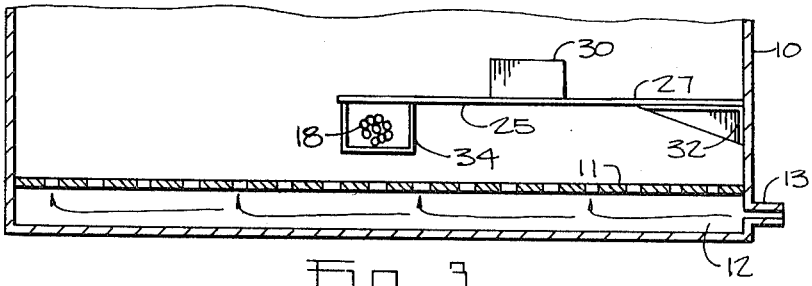

FIG. 3 illustrates a cantilevered form of apparatus. In this arrangement the bar 25 is rigidly attached at end 27 to a bracket 33 attached to the housing 10 and a vibrator 30, as in FIG. 1, is mounted on the bar. The vibrator 30 can be electrical, mechanical or pneumatic in form. In this example the cable is passed through a box-like member 34 at the free end of the bar, although a die or round member can be provided.

Figure 4:
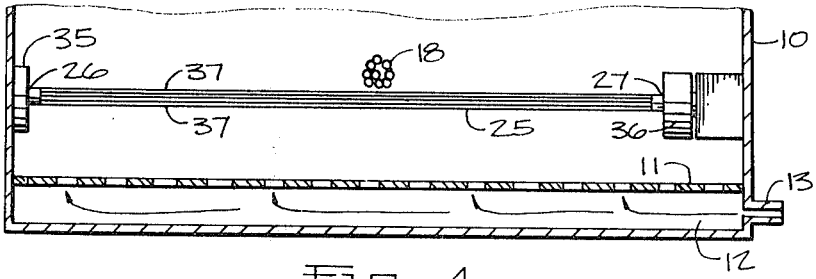

FIG. 4 illustrates a rotary bar 25. The bar is mounted at end 26 in a bearing 35 and at end 27 is attached to a rotary mechanism 36, such as an electric or pneumatic motor. On the bar 25 are formed one or more of lobes 37 extending axially along the bar. While in FIG. 4 the lobes are extending the length of the bar 25, they need only extend for a short distance at the position where the cable passes over the bar. As the bar 25 rotates the lobes vibrate or shake the cable vertically.

The form of the bar 25 can vary. In FIG. 4 the bar will be cylindrical with the lobes extending the length of the bar, or for part of the length. In FIGS. 1 and 2 the bar can be narrow or relatively wide. It can have a flat top surface or an acuate one. The bar is usually of metal, but other materials can be used, and the top surface is usually highly polished to reduce friction and prevent damage. The actual contact surface can be of a material having a low coefficient of friction and also capable of resisting wear. While generally a bar has been shown, other forms of vibratory member can be used. Thus, in the example illustrated in FIG. 3, the member 34 could be mounted on the top end of a vertically vibrating member. The desired result is a vibrating or shaking of the cable while it passes through the fluidized powder.

As stated, it is believed that the action of vibrating the cable is to assist in maintaining the fluidized medium in a fluidized more uniform distribution of the medium in the cable interstices. When a fluidized medium enters a non-vibrating cable, the medium is separated from the fluidizing action of the bed and thus begins to lose the fluid properties, settling out in the cable. This can result in areas of the cable which are not filled properly or are packed with too much powder. It is believed that vibration of the cable slows down the deterioration of the fluid properties of the fluidized medium, or may maintain or even increase the fluid properties, thus helping the medium to fill all the interstices and reducing the settling out action.

Use of the invention has resulted in considerable improvements in capacitance deviation. The frequency of the vibratory action has an effect on the degree of improvement. Improvements of up to 50% over a cable filled simply by passing through a fluidized bed without vibration have been obtained. A typical example, with a 50 pair 19 AWG gauge cable running through a fluidized bed at 100 rpm is as follows:-

| RMP of bar | .0 | 500 | 1000 | 1625 | 2000 |
|---|---|---|---|---|---|
| Ave. mutual capacitance | 81.5 | 80.0 | 80.8 | 82.4 | 83.0 |
| Coefficient of Deviation, % | 2.56 | 2.75 | 2.91 | 1.4 | 1.27 |

It will be seen that an abrupt change in deviation occurred at about 1625 rmp. High frequencies, for example in the range of 10,000 to 12,000 rpm have been used, with amplitudes of about 0.030". Frequencies of up to about 2500 rpm have been used with an amplitude of about ¼" and this frequency has also been used with amplitudes of about ⅛". Frequencies of up to 4000 rpm at ⅛" amplitude are used. Depending upon the characteristics of the cable or cable unit, that is number of pairs and wire gauge, the frequency can be varied for optimum effectiveness, and also the amplitude. Even higher frequencies of in the 4,000 to 10,000 rpm range have been tried. At the very high frequencies the mutual capacitance can be made to decrease, thus indicating control over the percent fill, of powder, in the cable. Cables having conductors of other sizes, for example 22 AWG and 26 AWG have been filled and considerable results obtained at approximately the same frequencies. Approximately 1600 rpm appears to be critical.

It will be appreciated that the vibratory motion, particularly the amplitude, must be such that damage is not caused to the cable. Also, the frequency, and amplitude, are such that the cable remains substantially in contact with the vibrating or shaking member. The speed of the cable through the fluidized bed can also be varied, and this can assist in maintaining the cable in contact with the vibrating member. The length of the bed can also be varied.

After leaving the fluidized bed the cable or cable unit can be wrapped with a metal, or other, tape. As seen in FIG. 5, the cable or unit 18 can be wrapped by tape 38 applied by a former 39, in the example illustrated the former having a tapered inlet portion 39*a* and parallel rear portion 39*b*.

Figure 7:
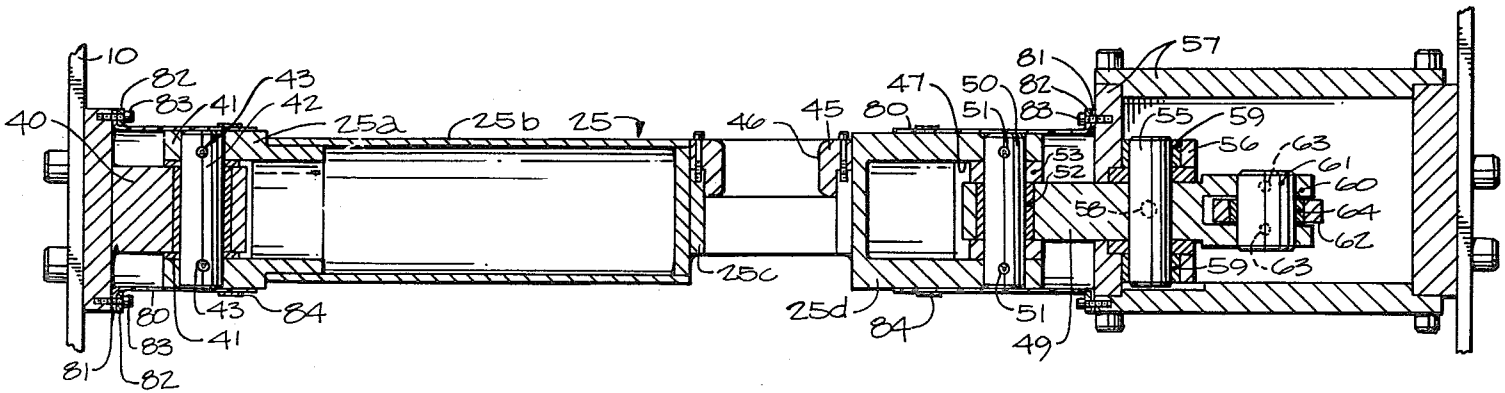
FIGS. 7 and 8 are cross-sections on the lines VII—VII and VIII—VIII respective of FIG. 6.
Figure 8:
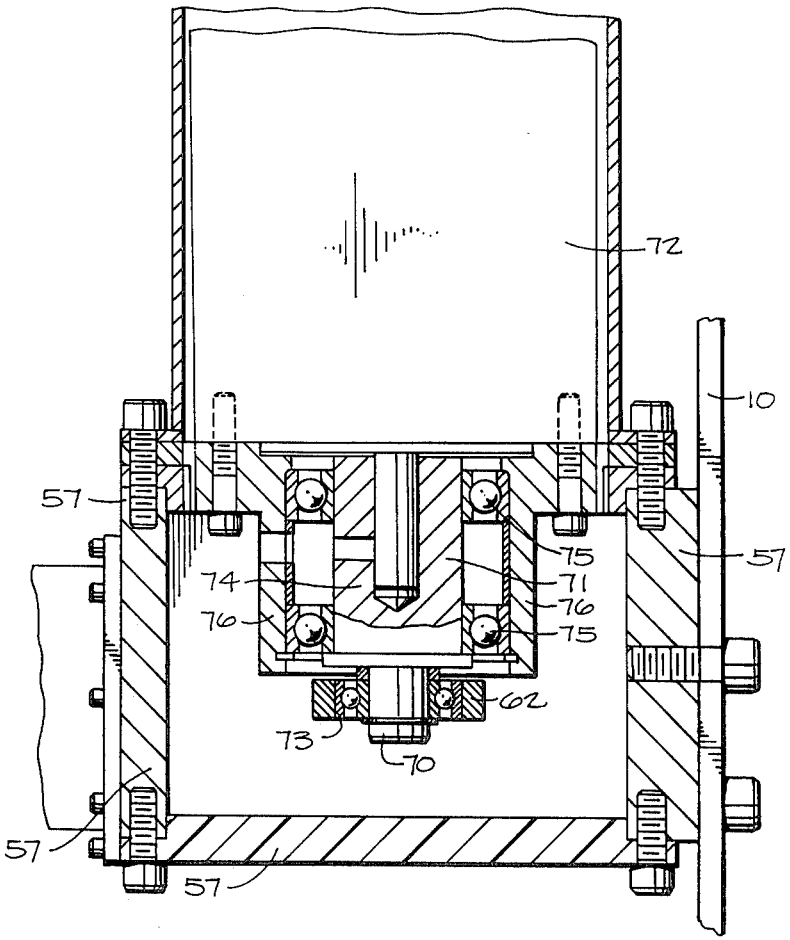

FIGS. 6, 7 and 8 illustrate in more detail a specific form of apparatus. In this example the bar is vibrated via a connecting rod mounted on an eccentric. Also, in this example, the cable passes through a housing or bush mounted on the bar, the bush being a fairly loose sliding fit on the cable. The cable rests on the lower side or portion of the bushing.

FIGS. 6, 7 and 8 illustrate in more detail a vibrating bar arrangement in which the bar is vibrated by means of an eccentric driven by an electric motor, for example as in FIG. 2. The bar 25 is built up of several portions 25*a*, 25*b*, 25*c* and 25*d*. Portion 25*a* is one end portion and is pivotally mounted on a spigot 40 attached to the housing 10. This corresponds to the pivotal mounting position 26 of FIG. 2. The spigot is of square cross-section and the end portion 25*a* has a square bore somewhat larger than the spigot, with spacers 41 either side and positioned on the pivot pin 42. The pivot pin 42 is fixed in the end 25*a*, as by screws 43, and pivots in a bearing 44 in the spigot 40. Attached to portion 25*a* is tubular portion 25*b*. This is conveniently of thin wall circular cross-section tube which is welded to portion 25*a*.

Portion 25*c* is an open ended box-shaped member attached to portion 25*b* and to portion 25*d*, extending between these two portions. Positioned in the box-shaped member or portion 25*c* is a removable member 45 having a bore 46 therethrough. The bore 46 is a loose fit on the cable, or cable unit, to be filled and different removable members can be provided with different diameter bores 46 to cater for a variety of cable diameters.

Portion 25*d* is to some extent a repetition of the portion 25*a*. It has a square bore 47 within which extends the end 48 of a pivotted lever 49. The portion 25*d* is pivotally connected to the end 48 of the lever by a pivot 50, which is fixed in the portion 25*d* as by screws 51, and pivots in a bearing 52 in the lever 49. Spacers 53 are positioned between the lever 49 and the portion 25*d*. Lever 49 is pivotally mounted at a position intermediate its ends on a pivot pin 55 mounted in a support 56 attached to a housing 57. The pin 55 is fixed in the lever 49 by a screw 58 and pivots in a bearing 59 in the support 56. At the end 60 of the lever 49 remote from end 48 is a further pivot pin 61. The end 60 of the lever is bifurcated and the lower end of a connecting rod or member 62 is positioned between the bifurcations and pivots on the pin 61. The pin is fixed in the lever as by screws 63 and a bearing 64 is provided in the member 62.

The upper end of the connecting rod or member is pivotally mounted on a pin 70 which is eccentrically mounted on the end of a shaft 74 driven by an electric motor 72. A ball bearing 73 is positioned between the connecting member 62 and the pin 70 and the pin 70 is part of a rotating member 74 supported by ball bearings 75 to reduce the loading on the bearings of the motor 72. The ball bearings 75 are carried in a support member 76 attached to the housing 57.

As viewed in FIG. 6, in which part of the front of the housing is shown broken away, rotation of the motor shaft 71 and thus of member 74 and eccentric pin 70 reciprocates the connecting member 62 up and down. This in turn reciprocates the lever 49 about the pivot pin 55. This moves the end portion 25*d* of the bar 25 up and down, as seen in FIG. 6, the bar pivotting about pin 42. This results in the member 45 reciprocating or vibrating up and down and this vibration is transmitted to the cable or cable unit passing through the bore 46. To exclude powder from the bearings at each end of the bar, that is at portions 25*a* and 25*d*, flexible sleeves 80 are provided. The sleeves have flanges 81 which are attached to the housing 57 at one end of the bar and to the housing 10 at the other end of the bar by clamping rings 82 and screws 83. The other ends of the sleeves are clamped to the portions 25*a* and 25*d* by clamping rings 84.

It will be seen that the amount of eccentricity of the pin 70 and the relative distances between the centres of pins 61 and 50 and the centre of pin 55 will decide the amplitude of the movement at pin 50. The relative distances between the centre of the bore 46 and the centres of pins 42 and 50 will decide the amplitude of vibration at the bore 46. It is possible to provide for different amplitudes by changing, for example, the member 74. This member is fixed to the shaft 71 of the motor by screw 85 and by release of the screw the member 76 and bearings 74 could be removed from the support member 76, and replaced by another member 74 in which the pin 70 has a different eccentricity. By using a variable speed motor, variation in the frequency of vibration can also be provided.

Figure 9:
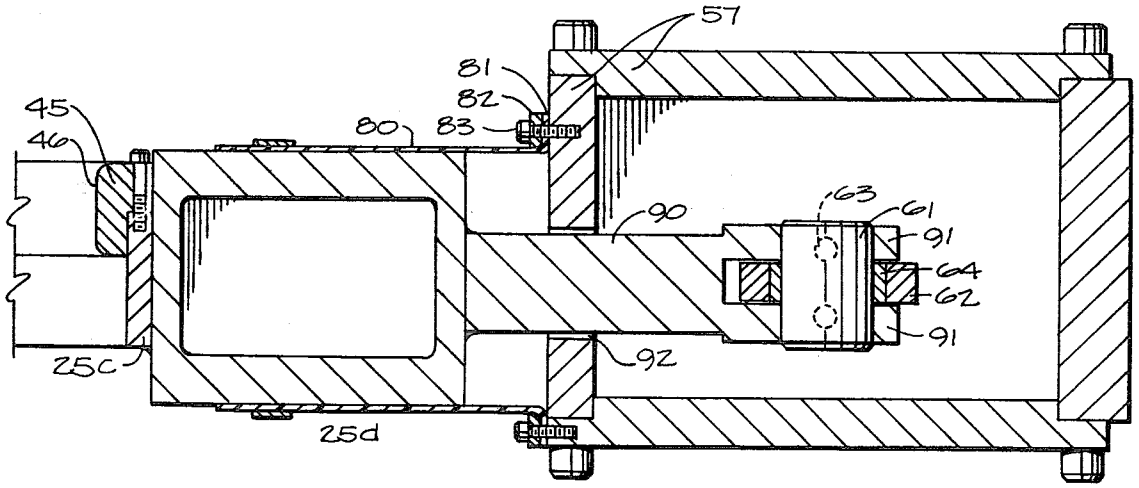
FIG. 9 is similar to a part of FIG. 6, and illustrates a modification.

FIG. 9 illustrates a modification of the arrangement of FIGS. 6, 7 and 8, in which the bar 25 is actuated directly by the connecting rod or member 62. FIG. 9 is very similar to FIG. 7, except that only the end portion 25*d* and part of portion of 25*c* are shown. End portion 25*d* has an extension 90 attached thereto, the extension 90 extending into the housing 57 and has a bifurcated end 91, similar to the bifurcated end 600 in FIG. 7. The end 91 is connected to the connecting member 62 via pin 61 which is fixed in the end 91 by screws 63 and pivots in a bearing 64 in the connecting member. This pivotal arrangement or connection between the connecting rod or member 62 and the end 91 of the extension 90, is similar to the connection between the connecting rod or member 62 and the end 60 of lever 49 in FIG. 7. The extension 90 moves in a slot 92 in the wall of the housing 57.

In the arrangement of FIG. 9, rotation of the motor shaft reciprocates the connecting rod or member 62 up and down which in turn causes the bar 65 to vibrate up and down, pivotting on pin 42. The amplitude of the vibration at the bore 46 will depend upon the eccentricity of the pin 70 and the relative distances between the centre of the pin 61 and the centre of the pin 2 and between the centre of the pin 61 and the centre or axis of the bore 46.

The turn bar in this description has been used in the broad sense in that the bar can have many forms. Thus it can be a flat member with the cable running over it. The upper surface, over which the cable runs, can be convex to reduce the possibility of damage. Alternatively the bar can be a square, round or of other cross-section. Where the bar is rotated, and has lobes or projections, the bar can be solid or tubular. For a vibrating bar again it can be solid or tubular. As illustrated in the particular embodiment, the cable, or cable unit may pass through a bore in the bar. The primary objective is to vibrate or shake the cable or cable unit in a direction substantially normal to its longitudinal axis, thereby facilitating the entry of the filling medium into the interstices between conductors.

While the invention has been described as used for a single cable or cable unit, a large cable may be opened up into several units, the units passed in spaced apart relationship through the fluidized bed, as described in application Ser. No. 930,236, filed Aug. 2, 1978, in the name of the present assignee. In such an arrangement a plurality of vibrating members would be provided, as necessary. More than one unit can be made to pass over one vibratory member if the vibratory arrangement is suitable.

What is claimed is:

1. A method of powder filling electric cables, comprising:
   - forming a fluidized bed of filling powder, passing a cable unit through the fluidized bed of powder, the unit in a substantially closed condition;
   - vibrating the cable unit in a direction substantially normal to the direction of movement of the cable unit through the fluidized bed.

2. A method as claimed in claim 1, including supplying powder to the fluidized bed at a rate to maintain a substantially constant bed thickness.

3. A method as claimed in claim 1, including wrapping the cable unit with a tape an exit from the fluidized bed.

4. A method as claimed in claim 1, wherein the cable is vibrated at a frequency above about 1600 rpm.

5. A method as claimed in claim 1, wherein the amplitude of the vibration is up to about $\frac{1}{4}''$.

6. A method as claimed in claim 1, wherein the amplitude of the vibration is about $\frac{1}{8}''$.

7. A method as claimed in claim 1, wherein the amplitude of the vibration is about 0.030".

8. A method as claimed in claim 1, wherein the frequency of the vibration is in the range of from about 4,000 to about 10,000 rpm.

9. A method as claimed in claim 1, wherein the frequency of the vibration is in the range of from about 1600 to about 2000 rpm.

10. Apparatus for powder filling electric cables, comprising:-
   - a housing having a bottom and inlet and outlet ends;
   - at least one inlet at said inlet end and at least one outlet at said outlet end, said inlet and outlet of a size to pass a cable unit in a substantially closed condition;
   - a porous member at the bottom of said housing and means for feeding air through said porous member for producing a fluidized bed of powder in the housing, a cable unit passing through said inlet and outlet being immersed in said fluidized bed when formed;
   - at least one member mounted in said housing for contact with said cable unit; and
   - means for causing the member to vibrate the cable unit as the cable unit passes through the fluidized bed, whereby the powder is caused to flow into the cable unit between conductors.

11. Apparatus as claimed in claim 10, said means for causing the member to vibrate the cable unit comprising a vibrator acting on said member.

12. Apparatus as claimed in claim 11, said member pivotally supported on one end and said vibrator mounted on said member adjacent to the other end of said member.

13. Apparatus as claimed in claim 11, said member cantilevered from one end, said vibrator mounted on said member adjacent to the other end of said member.

14. Apparatus as claimed in claim 10, said means for causing the member to vibrate the cable unit comprising a reciprocating member connected at one end to said member and means for reciprocating said lever attached to the other end of said lever.

15. Apparatus as claimed in claim 14, said member pivotally supported at one end, said reciprocating member pivotally attached to the other end of said member.

16. Apparatus as claimed in claim 14, said member pivotally supported at one end, a lever pivotably supported at a position intermediate its ends, said lever pivotally attached at one end to the other end of said member, said reciprocating member pivotally attached to the other end of said lever.

17. Apparatus as claimed in claim 10, said member comprising a bar mounted for rotation about the longitudinal axis of the bar, the longitudinal axis of the bar being transverse to the direction of movement of the cable unit through the housing, said means for causing the member to vibrate the cable unit comprising at least one lobe on the bar and means for rotating the bar.

18. Apparatus as claimed in claim 10, including tape wrapping means adjacent to said outlet for wrapping a tape around said cable unit on exit through said outlet.

19. Apparatus as claimed in claim 10, including a preforming member in front of said entry for preforming of conductors forming said cable unit prior to entry into said housing.

20. Apparatus as claimed in claim 10, said member comprising a flat bar.

21. Apparatus as claimed in claim 10, said member including a box-shaped portion intermediate the ends of the member and a bore in the box-shaped portion, the axis of the bore parallel to the axis of the path of the cable unit, whereby the cable unit passes through said bore, when in operation.

* * * * *